US011189145B2

(12) United States Patent
Hennegan

(10) Patent No.: US 11,189,145 B2
(45) Date of Patent: Nov. 30, 2021

(54) AIR SAMPLING SMOKE DETECTOR AND METHOD OF INGESTING AIR THEREIN

(71) Applicant: MLH FIRE PROTECTION LTD., Saint-Eustache (CA)

(72) Inventor: Michael L. Hennegan, Saint-Eustache (CA)

(73) Assignee: MLH FIRE PRODUCTION LTD., Saint-Eustache (CA)

( * ) Notice: Subject to any disclaimer, the term of this patent is extended or adjusted under 35 U.S.C. 154(b) by 8 days.

(21) Appl. No.: 16/815,461

(22) Filed: Mar. 11, 2020

(65) Prior Publication Data

US 2020/0294378 A1 Sep. 17, 2020

Related U.S. Application Data

(60) Provisional application No. 62/817,039, filed on Mar. 12, 2019.

(51) Int. Cl.
*G08B 17/113* (2006.01)

(52) U.S. Cl.
CPC ..... *G08B 17/113* (2013.01)

(58) Field of Classification Search
CPC ..... G08B 17/113; G08B 17/10
See application file for complete search history.

(56) References Cited

U.S. PATENT DOCUMENTS

| | | | | |
|---|---|---|---|---|
| 4,608,556 | A * | 8/1986 | Cole | G08B 17/06 340/628 |
| 8,065,922 | B2 | 11/2011 | Ajay et al. | |
| 8,106,785 | B2 | 1/2012 | Yokota | |
| 2011/0050433 | A1* | 3/2011 | Luterotti | B05B 1/00 340/628 |
| 2015/0310717 | A1* | 10/2015 | Al-Farra | G08B 17/12 340/628 |
| 2016/0223437 | A1 | 8/2016 | Ajay et al. | |

* cited by examiner

*Primary Examiner* — Brian Wilson
(74) *Attorney, Agent, or Firm* — Norton Rose Fulbright Canada

(57) ABSTRACT

The air sampling smoke detector (ASSD) system includes a sampling detector configured to detect smoke in an air flow, a pipe fluidly connected to the sampling detector. The pipe includes at least one aspiration orifice defined therein, and a variable flow restrictor covering the at least one aspiration opening and including an insert received therein. The insert has a restricted opening defined therethrough. The restricted opening provides fluid communication between the pipe and an exterior of the ASSD system. The insert being removable from the at least one aspiration orifice when the variable flow restrictor is heated above a predetermined temperature thereby providing an unrestricted opening providing fluid communication between the pipe and the exterior of the ASSD system. The unrestricted opening has a cross-sectional area greater than a cross-sectional area of the restricted opening.

20 Claims, 2 Drawing Sheets

AIR SAMPLING SMOKE DETECTOR AND METHOD OF INGESTING AIR THEREIN

CROSS-REFERENCE

The present application claims priority on U.S. Patent Application No. 62/817,039 filed Mar. 12, 2019, the entire content of which is incorporated herein by reference.

TECHNICAL FIELD

The application relates generally to smoke detectors and, more particularly, to an air sampling smoke detector.

BACKGROUND

Smoke detectors can be used to protect against fires by detecting a presence of smoke in air. The presence of smoke detected in the air is generally associated with a potential fire. However, existing smoke detectors can sometimes generate both false alarms and nuisance alarms. False alarms occur when a non-fire related substance, such as dust, moisture, refrigerants, etc., are detected and misinterpreted by the detector as a fire. Nuisance alarms are the result of detecting an actual product of combustion, but attributing it to a dangerous source (e.g. an uncontrolled fire) when it is in fact caused by a more benign source (e.g. smoke from cooking, a fireplace, or candles, for example).

To reduce the occurrence of at least false alarms, sampling smoke detectors have been introduced to replace traditional smoke detectors. Sampling smoke detectors typically analyze samples of air to discriminate smoke from other particles such as dust or moisture. Still, sampling smoke detectors may suffer from an inability to distinguish a nuisance source producing smoke from a hazardous fire.

SUMMARY

In one aspect, there is provided an air sampling smoke detector (ASSD) system comprising a sampling detector configured to detect smoke in an air flow; a pipe fluidly connected to the sampling detector, the pipe includes at least one aspiration orifice defined therein; and a variable flow restrictor covering the at least one aspiration opening and including an insert received therein, the insert having a restricted opening defined therethrough, the restricted opening providing fluid communication between the pipe and an exterior of the ASSD system, the insert being removable from the at least one aspiration orifice when the variable flow restrictor is heated above a predetermined temperature thereby providing an unrestricted opening providing fluid communication between the pipe and the exterior of the ASSD system, the unrestricted opening having a cross-sectional area greater than a cross-sectional area of the restricted opening.

In another aspect, there is provided a variable flow restrictor for an air sampling smoke detector (ASSD), the variable flow restrictor comprising a body configured to cover an aspiration orifice defined in a pipe of the ASSD, an unrestricted opening defined through the body between a distal end and a proximal end, the proximal end adapted to fluidly communicate with the pipe; and an insert covering the distal end and including a restricted opening defined therethrough, a neck of the restricted opening being smaller than a neck of the unrestricted opening, the insert configured to uncover the distal end of the unrestricted opening when the variable flow restrictor is exposed to heat above a predetermined temperature.

In a further aspect, there is provided a method for detecting a fire condition using an air sampling smoke detector (ASSD) and a variable flow restrictor, the method comprising: ingesting a baseline flow rate into the variable flow restrictor through a restricted opening defined in an insert of the variable flow restrictor; allowing the insert to be removed when the variable flow restrictor is exposed to heat above a predetermined temperature; and ingesting an increased flow rate into the variable flow restrictor through an unrestricted opening thereof, the increased flow rate being greater than the baseline flow rate.

BRIEF DESCRIPTION OF THE DRAWINGS

Reference is now made to the accompanying figures in which.

DETAILED DESCRIPTION

Figure 1A:
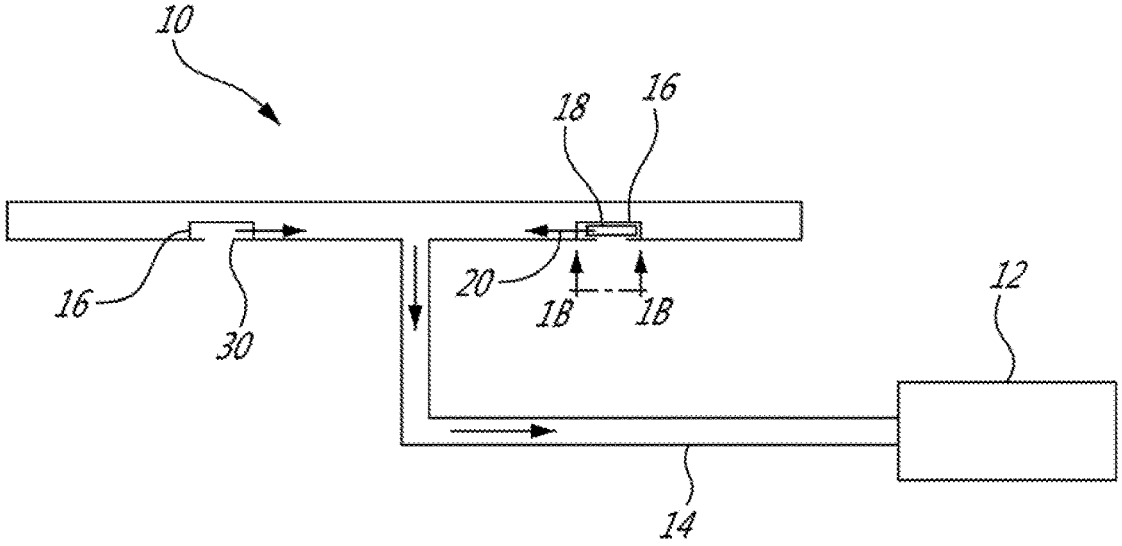
FIG. 1A is a schematic view of an air sampling smoke detector (ASSD) system.

FIG. 1A illustrates an air sampling smoke detector (ASSD) system 10. The ASSD system 10 is a system that can be used in fire protection and prevention to monitor an area such as a room, a chamber, an interior of a building, and the like. The monitored area represents an exterior of the ASSD system 10 that is monitored for signs of a potential hazardous fire. In the embodiment shown in FIG. 1A, the ASSD system 10 includes a sampling detector 12, a pipe 14 or piping system fluidly connected to the sampling detector 12, one or more aspiration orifices 16 defined in the pipe 14, and a variable flow restrictor 18 covering at least one of the aspiration orifices 16 and which provides a variable pathway through which an air flow 20 may enter the ASSD system 10. In some embodiments, the variable flow restrictor 18 provides a sole inlet of the pipe 14 through the aspiration opening 16. In use, the air flow is ingested or drawn into the ASSD system 10 through the variable flow restrictor 18 and channeled through the pipe 14 to provide air samples to the sampling detector 12. The variable flow restrictor 18 may also be referred to as a "multi sensor aspiration point" because the variable flow restrictor 18 acts as a single point of ingesting a baseline flow rate under a safe condition and ingesting an increased flow rate under a hazard condition. The term "safe condition" is intended to refer to conditions that are not normally representative of a fire, such as low temperatures. The term "hazard condition" is intended to refer to conditions that are representative of a fire, such as elevated temperatures. As such, a heat source may trigger the increase in flow rate through the variable flow restrictor 18.

The sampling detector 12 is a detector that is suitable to detect the presence of smoke particles suspended in the air samples. For example, the sampling detector 12 may detect light scattered by the smoke particles to detect the presence of smoke. It is understood that any other detector suitable to detect the presence of smoke, measure the quantity of smoke in the air, and the like, may be used in the ASSD system 10.

The ASSD system 10 may include a filter to remove contaminants such as dust, moisture, and the like, from the air samples.

Figure 1B:
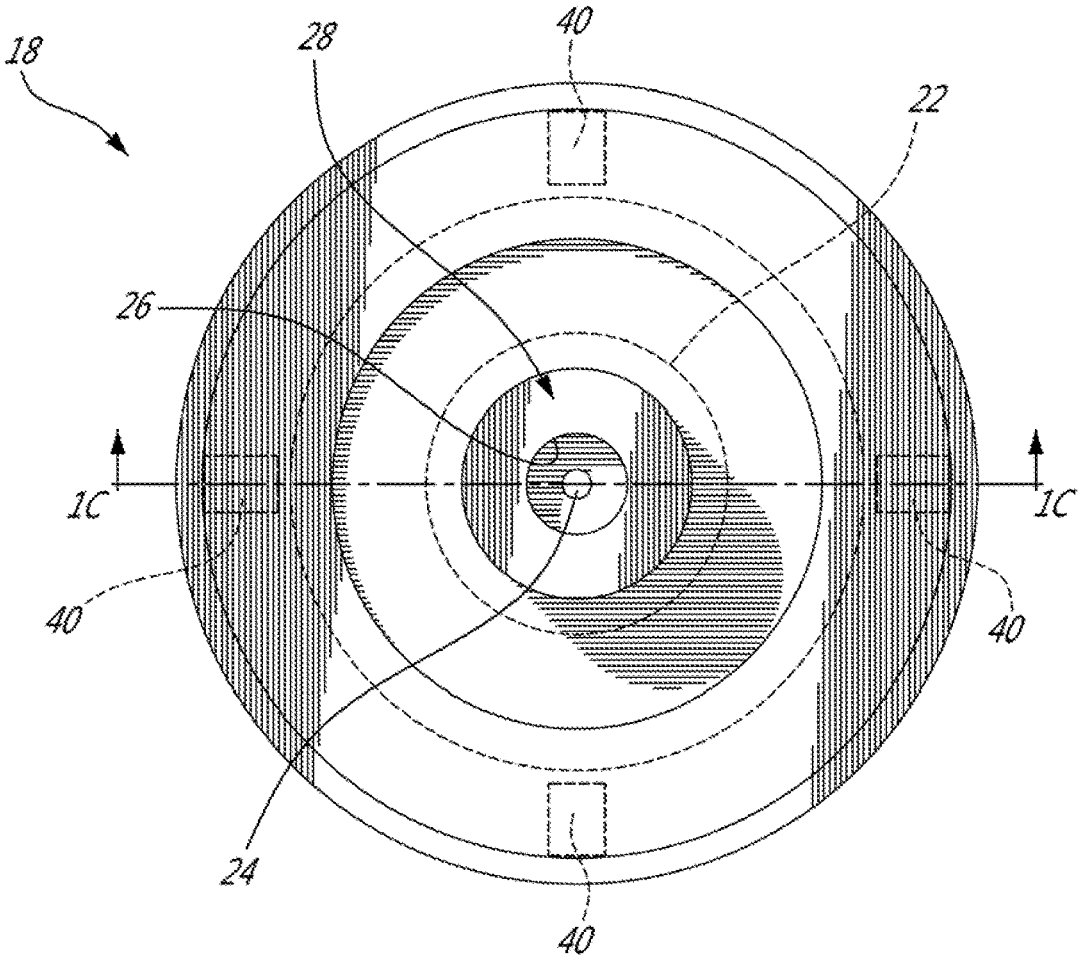
FIG. 1B is a top planar view of a variable flow restrictor of the ASSD system of FIG. 1A.
Figure 1C:
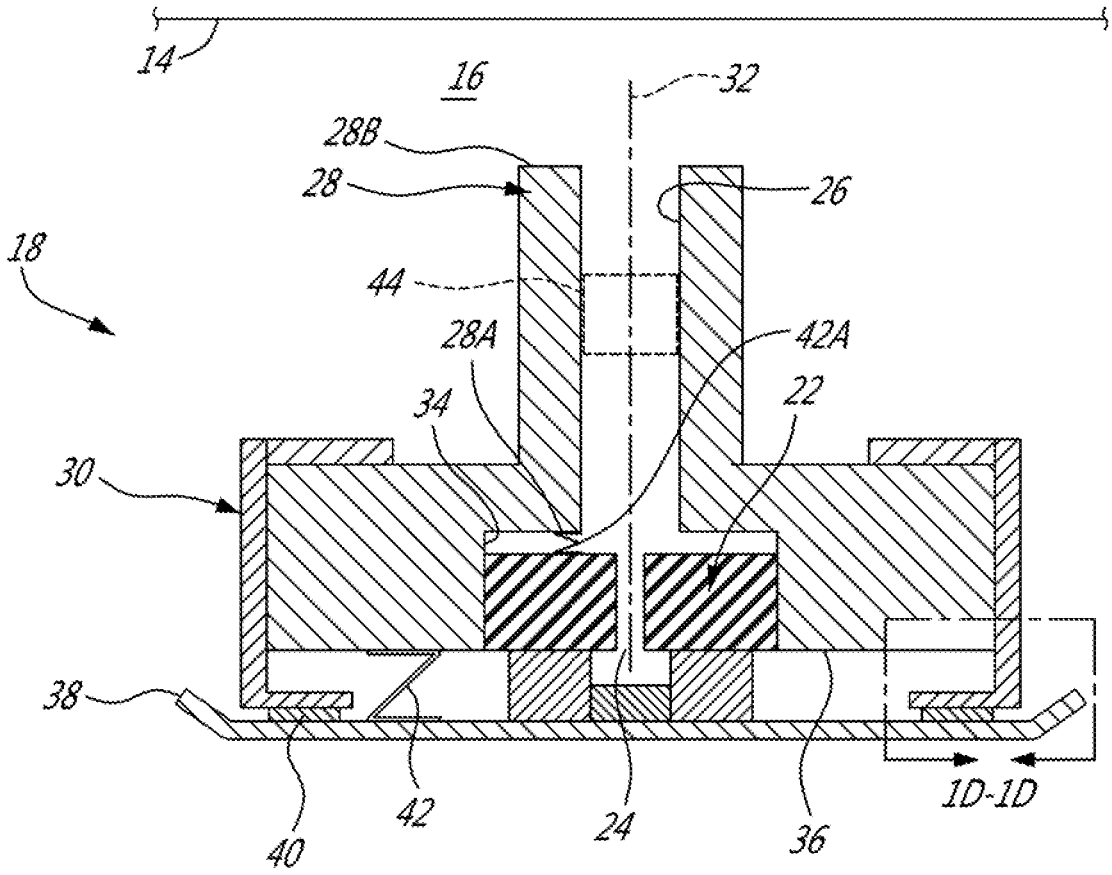
FIG. 1C is a cross-sectional view of the variable flow restrictor taken along line 1C-1C of FIG. 1B.

Referring to FIGS. 1B-1C, a top view (FIG. 1B) and a cross-sectional view (FIG. 10) of the variable flow restrictor 18 are shown. The variable flow restrictor 18 is mountable to the pipe 14 to cover the aspiration orifice 16. The variable flow restrictor 18 includes an insert 22 that has a restricted opening 24 defined therethrough. The term "restricted" is relative to a larger "unrestricted" opening 26, such as the aspiration orifice 16. Thus, the openings 24, 26 provide, selectively, a path of the air flow to deliver the variable air flow into the ASSD system 10. The openings 24, 26 may have different shapes selected from any one of a cylindrical, oval, polygonal, tapered, and the like.

In use, under the safe condition when the variable flow restrictor 18 is at or below a predetermined temperature, the restricted opening 24 allows a baseline air flow into the pipe 14 through the variable flow restrictor 18. That is, the air flow rate drawn into the pipe 14 through the restricted opening 24 is characterized as the baseline air flow. Under the hazard condition when the variable flow restrictor 18 is heated above the predetermined temperature, the unrestricted opening 26 allows an increased air flow into the pipe 14 through the variable flow restrictor 18 relative to the baseline flow rate.

The insert 22 may be removable from the variable flow restrictor 18 to uncover the unrestricted opening 26 when the variable flow restrictor 18 is heated above the predetermined temperature. For example, the insert 22 may melt above the predetermined temperature to uncover the unrestricted opening 26. Additionally or alternately, the insert 22 may be disconnected from the variable flow restrictor 18 when the variable flow restrictor 18 is heated above the predetermined temperature and removed from the restricted opening 26 by gravitational force, by an ejector, or both. As such, the insert 22 is removed to uncover the unrestricted opening 26 when the variable flow restrictor 18 is heated at the elevated temperatures that are representative of the hazard condition and/or fire.

In the embodiment shown in FIGS. 1B-1C, the variable flow restrictor 18 includes a body 28 extending in the aspiration orifice 16. Referring more particularly to FIG. 10, the unrestricted opening 26 is defined through the body 28 between a distal end 28A and a proximal end 28B. The proximal end 28B fluidly communicates with the pipe 14. In the embodiment shown in FIG. 10, a periphery of the proximal end 28B is disposed in the pipe 14. It is understood that any attachments suitable to provide fluid communication between the proximal end 28B and the pipe 14 may be used. For example, the body 28 may be adapted to surround the aspiration orifice 16. The body 28 may be disposed in a frame 30 extending from the pipe 14. For example, the frame 30 may be a receptacle attached to the pipe 14 for receiving the body 28. The variable flow restrictor 18 may include a tube or any other suitable connection to fluidly connect the body 28 to the pipe 14. The body 28 may be circular as shown in FIG. 1B, or may have a different shape suitable to ingest the air flow from the exterior of the ASSD system 10 or the monitored area into the pipe 14.

In the embodiment shown in FIG. 10, a longitudinal axis 32 of the openings 24, 26 is shown. The unrestricted opening 26 has a cross-sectional area transverse to the longitudinal axis 32 that is greater than a cross-sectional area of the restricted opening 24 that is transverse to the longitudinal axis 32. In other words, a neck of the restricted opening 24 may be smaller than a neck of the unrestricted opening 26. The term "neck" is intended to refer to a smallest cross-section of the corresponding opening 24, 26. In other words, the restricted opening 24 would allow a lower mass air flow into the pipe 14 relative to the unrestricted opening 26.

A seat 34 is defined in the body 28 to receive the insert 22. The seat 34 extends in the body 28 from an outer surface 36 thereof facing toward the ground. The seat 34 is oriented to face toward the ground such that gravitational forces bias the insert 22 away from the body 28 when the insert 22 is disposed in the seat 34. It is noted that other orientations of the insert 22 are within the scope of the present disclosure. The insert 22 may be unconnectedly disposed in the seat 34. That is, the insert 22 may be not directly connected to the body 28. In some embodiments, the insert 22 may be directly connected to the body 28.

Figure 1D:
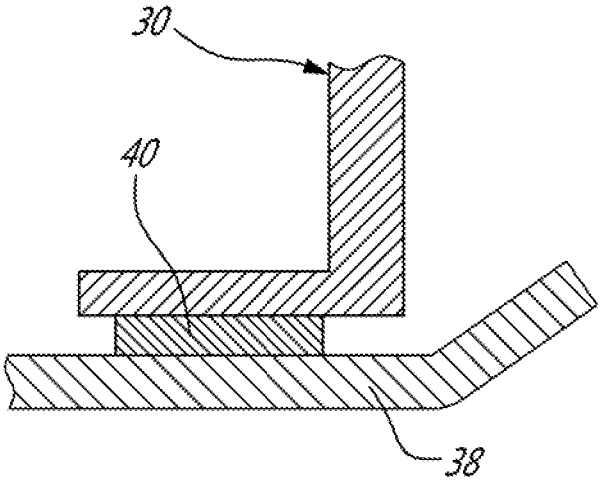
FIG. 1D is an enlarged view of a connector of the variable flow restrictor, from region 1D-1D of FIG. 1C.

The variable flow restrictor 18 may include a cover 38 to retain and/or restrain the insert 22 in the seat. The cover 38 may also serve to conceal the internal features of the assembly, for aesthetic purposes. Thus, the cover 38 may retain the insert 22 such that the insert 22 is sandwiched between the cover 38 and the body 28. A connector 40 may connect the cover 38 to the body 28, to the frame 30, or both. The connector 40 may be a solder, or any other suitable material to connect the cover 38 to the body 28 and/or to the frame 30. FIG. 1D illustrates an enlarged view of the connector 40. In use, a suitable filler material may be applied to solder and connect the cover 38 to the frame 30. Any one of a number of different types of solders, each of which allows for a range of melting temperatures, can be selected and used as required. Other types of materials can also be used instead of solders. For example, waxes, plastics, etc. can also be used to connect the cover 38 to the frame 30. Alternately still, a glass bulb that connects the cover 38 to the frame 30 can also be used, wherein the glass shatters when the fluid pressure increases due to thermal expansion. (An air bubble of a given size is used to permit a certain amount of expansion within the bulb before the glass will shatter, and this determines the set temperature of the glass bulb and thus the device having same.) Regardless of the material and/or structure used (solder, wax, plastic, glass bulb, etc.), the material and structure formed thereof are selected, among other things, based on their strength and ability to control a precise melting point. The connector 40 may melt above the predetermined temperature to disconnect the cover 38 from the body 28 and consequently un-retain and/or un-restrain the insert 22 to remove the insert 22 from the body 28 under gravitational forces. A melting temperature of the connector 40 may be lower than a melting temperature of the insert 22. Additionally, the insert 22 can be formed of a material that itself would melt. Alternately still, the insert 22 can be made of a non-melting substance that is held in place with solder, wax, etc, which itself melts at predetermined known temperature. One possible advantage of the use of a non-melting insert 22, is that it cannot then inadvertently obstruct the opening 26 once the melting temperature is reached.

In some embodiments, the connector 40 has the lowest melting temperature of the variable flow restrictor 18. That is, when the variable flow restrictor 18 is exposed to heat, the connector 40 melts prior to the body 28, the insert 22, the cover 38, and the like. In some embodiments, the insert 22 may have the lowest melting temperature of the variable flow restrictor 18, however because the insert 22 would then still be held in place by the cover 38, the aforementioned alternative, wherein the connector 40 has the lowest melting temperature, may be preferred. In the embodiment shown in FIG. 1B, four connectors 40 are used to connect the cover 38 to the frame 30. The four connectors 40 are equally distributed along a circumference of the cover 38. It is understood that any other suitable number of connectors 40 may be used to connect the cover 38 to the frame 30 and/or to the body 28. In some embodiments, the insert 22 may be connected directly to the pipe 14, retained between the pipe 14 and the cover 38, or both.

The variable flow restrictor 18 may include one or more springs 42 mounted between the body 28 and the cover 38 to bias the cover 38 away from the body 28. While the spring 42 may be any type of suitable spring or biasing element, in at least one embodiment the spring 42 is one of a helical compression spring, a flat spring, and a conical spring washer. In use, the spring 42 is compressed and mounted between the cover 38 the body 28 in a preloaded-compression state. As such, when the connector 40 starts to sufficiently melt due to the elevated temperature, the spring 42 ejects the cover 38 away from the body 28 to allow the insert 22 to fall out due to the gravitational forces. The spring 42, or an additional spring 42A, may be mounted between the insert 22 and the body 28 to bias the insert 22 away from the body 28. For example, when the insert 22 is disposed in a way such as the gravitational forces are not enough to remove the insert 22 from the body 28 and/or to uncover the unrestricted opening 26, the spring 42 may be used to eject the insert 22 away from the unrestricted opening 26.

The ASSD system 10 also includes a flow sensor, as will now be described. In the depicted embodiment, the variable flow restrictor 18 includes the flow sensor 44, which is operable to measure the flow rate of the air through the system, and more specifically the flow rate of the air entering the pipe 14 through the variable flow restrictor 18. The flow sensor 44 may be a mass flow sensor, a volumetric flow sensor, or another device capable of measuring flow rate. For example, ultrasonic flow rate detectors or hot wire resistance detectors may also be used as part of the flow sensor 44.

Although the flow sensor 44 in the present embodiment forms part of each of the variable flow restrictors 18, it is to be understood that in an alternate embodiment of the ASSD system 10, a single sensor located at a point in the system where it is capable of sensing a change in the total airflow through a pipe common to all of the variable flow restrictors 18. In this embodiment, the flow sensor can give an indication of a variable flow restrictor having been activated, without showing precisely which one. This embodiment may be advantageous if one wishes to avoid connecting many flow sensors, and there is not a need to be able to know precisely which variable flow restrictor (and thus precisely which location in the system) has been activated. In yet another alternate arrangement, a number of flow sensors are provided and all connected to various pipes which then establish "zones" within the greater system.

Accordingly, flow rate detection can be performed either at each nozzle, requiring communication between each nozzle and the aspirated smoke detection sensor (or control unit), or it can be done with one measuring device located either in the pipe 14, which carries the combined flow to the ASSD 12 (see FIG. 1). Alternately, flow rate detection can also be done using several flow rate detectors located on branch lines, in order to divide the system into zones. Such a zone-based system may be desirable for large systems.

Regardless of the configuration, in operation, the mass flow sensor 44 sends a signal indicative of the flow rate passing therethrough. A baseline flow rate signal represents the flow rate through the insert 22 and an increased flow rate signal represents the flow rate when the insert 22 is removed. As such, the ASSD system 10 may detect the elevated temperature in the monitored area.

A method for detecting the increase of ingested air flow through the variable flow restrictor 18 may include ingesting the baseline flow rate through the restricted opening 24, removing the insert 22 when the variable flow restrictor 18 is exposed to heat above the predetermined temperature, and subsequently ingesting the increased flow rate through the unrestricted opening 26.

An algorithm may be used with the ASSD system 10 such that the presence of smoke under conditions of normal baseline flow rate can be associated with a low level warning. An increase in the air flow rate through the variable flow restrictor 18 in the absence of smoke can be interpreted as a broken pipe 14, or a damaged variable flow restrictor 18 by indicating a trouble warning on the ASSD system 10 without issuing an alarm. A flow rate increase concurrently with a detection of smoke can be interpreted as a hazardous fire.

The variable flow restrictor 18 may be connected to a traditional dry pipe fire sprinkler system in such a way that a thermal element of the ASSD system 10 can be notably lower than that of an automatic sprinkler head. As such, the ASSD system 10 may still provide the early warning of a potential hazardous fire that is expected of a sampling smoke detection system, in addition to providing releasing water into the system piping before the actuation of a sprinkler head. This "pre-loading" of the sprinkler piping may prevent a 30% increase as may be required by the Standard for the Installation of Sprinkler Systems in NFPA13 for dry sprinkler or double interlock preaction systems. This may apply equally to double interlock preaction systems and to improve water delivery time on single interlock preaction systems as well.

The variable flow restrictor 18 may be used in a fire sprinkler system having combined detection and distribution piping as described in U.S. Pat. No. 9,242,130 to Hennegan, which is incorporated herein by reference in its entirety.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. An air sampling smoke detector (ASSD) system comprising:

a sampling detector configured to detect smoke in an air flow;

a pipe fluidly connected to the sampling detector, the pipe includes at least one aspiration orifice defined therein; and a variable flow restrictor covering the at least one aspiration orifice and including an insert received therein, the insert having a restricted opening defined therethrough, the restricted opening providing fluid communication between the pipe and an exterior of the ASSD system, the insert being removable from the at least one aspiration orifice when the variable flow restrictor is heated above a predetermined temperature thereby providing an unrestricted opening providing fluid communication between the pipe and the exterior of the ASSD system, the unrestricted opening having a cross-sectional area greater than a cross-sectional area of the restricted opening.

2. The ASSD system as defined in claim 1, wherein the variable flow restrictor provides a sole inlet for the air flow into the pipe.

3. The ASSD system as defined in claim 1, comprising a mass flow sensor mounted to the variable flow restrictor, the mass flow sensor measuring a baseline flow rate through the restricted opening and measuring an increased flow rate through the unrestricted opening.

4. The ASSD system as defined in claim 1, wherein the variable flow restrictor includes a body and a connector connecting the insert to the body, at least one of the connector and the insert melting above the predetermined temperature.

5. The ASSD system as defined in claim 1, wherein the insert melts above the predetermined temperature.

6. The ASSD system as defined in claim 1, wherein the variable flow restrictor includes a spring biasing the insert away from the at least one aspiration orifice.

7. The ASSD system as defined in claim 1, wherein the variable flow restrictor includes a cover retaining the insert in the at least one aspiration orifice, a connector connecting the cover to a body of the variable flow restrictor, and a spring biasing the cover away from the body, the insert unconnectedly disposed between the body and the cover.

8. The ASSD system as defined in claim 1, wherein the insert is disposed in the variable flow restrictor such that a gravitational force biases the insert away from the variable flow restrictor.

9. A variable flow restrictor for an air sampling smoke detector (ASSD), the variable flow restrictor comprising:

a body configured to cover an aspiration orifice defined in a pipe of the ASSD, an unrestricted opening defined through the body between a distal end and a proximal end, the proximal end adapted to fluidly communicate with the pipe; and an insert covering the distal end and including a restricted opening defined therethrough, a neck of the restricted opening being smaller than a neck of the unrestricted opening, the insert configured to uncover the distal end of the unrestricted opening when the variable flow restrictor is exposed to heat above a predetermined temperature.

10. The variable flow restrictor as defined in claim 9, wherein the insert melts above the predetermined temperature.

11. The variable flow restrictor as defined in claim 9, comprising a cover retaining the insert and a connector connecting the cover to the body such that the insert is sandwiched between the cover and the body, at least one of the connector and the insert melting above the predetermined temperature, the insert unconnectedly disposed between the body and the cover.

12. The variable flow restrictor as defined in claim 9, comprising a cover retaining the insert and a connector connecting the cover to the body such that the insert is sandwiched between the cover and the body, the connector melting above the predetermined temperature, the insert unconnectedly disposed between the body and the cover, and a spring mounted between the cover and the body and biasing the cover away from the body.

13. The variable flow restrictor as defined in claim 12, wherein the connector is a solder having a lower melting point relative to the insert.

14. The variable flow restrictor as defined in claim 9, comprising a connector connecting the insert to the body and a spring mounted between the insert and the body, the spring biasing the insert away from the body.

15. A method for detecting a fire condition using an air sampling smoke detector (ASSD) and a variable flow restrictor, the method comprising:

ingesting a baseline flow rate into the variable flow restrictor through a restricted opening defined in an insert of the variable flow restrictor;

allowing the insert to be removed when the variable flow restrictor is exposed to heat above a predetermined temperature; and ingesting an increased flow rate into the variable flow restrictor through an unrestricted opening thereof, the increased flow rate being greater than the baseline flow rate.

16. The method as defined in claim 15, comprising melting the insert above the predetermined temperature such as to remove the insert away from the unrestricted opening.

17. The method as defined in claim 15, comprising melting a connector above the predetermined temperature such as to remove the insert away from the unrestricted opening, the connector connecting a cover to a body of the variable flow restrictor, wherein the insert is unconnectedly disposed between the body and the cover.

18. The method as defined in claim 15, comprising biasing the insert away from the unrestricted opening.

19. The method as defined in claim 15, comprising sending a signal indicative of a corresponding one of the baseline flow rate and the increased flow rate.

20. The method as defined in claim 15, wherein the variable flow restrictors forms part of the air sampling smoke detectors (ASSD).

* * * * *